US009405210B2

(12) United States Patent
Yamaguchi et al.

(10) Patent No.: US 9,405,210 B2
(45) Date of Patent: Aug. 2, 2016

(54) IMAGE FORMING APPARATUS AND IMAGE FORMING UNIT

(71) Applicant: FUJI XEROX CO., LTD., Tokyo (JP)

(72) Inventors: Mikio Yamaguchi, Kanagawa (JP); Ichiro Kawahara, Kanagawa (JP); Hiroki Ando, Kanagawa (JP); Keishi Araki, Kanagawa (JP); Hirofumi Iida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/611,591

(22) Filed: Feb. 2, 2015

(65) Prior Publication Data

US 2016/0018752 A1 Jan. 21, 2016

(30) Foreign Application Priority Data

Jul. 17, 2014 (JP) ..... 2014-147072

(51) Int. Cl.
*G03G 15/02* (2006.01)

(52) U.S. Cl.
CPC ..... *G03G 15/0225* (2013.01)

(58) Field of Classification Search
CPC ..... G03G 15/0225; G03G 2221/1815; G03G 15/0258
See application file for complete search history.

(56) References Cited

U.S. PATENT DOCUMENTS

2013/0251393 A1* 9/2013 Yamaguchi ..... G03G 15/0225 399/100

FOREIGN PATENT DOCUMENTS

| | | |
|---|---|---|
| JP | 2009-080304 A | 4/2009 |
| JP | 2009-116373 A | 5/2009 |
| JP | 2011-028305 A | 2/2011 |

OTHER PUBLICATIONS

Machine translation of Kubo et al., JP 2011-028305 (2011).*

* cited by examiner

*Primary Examiner* — David Gray
*Assistant Examiner* — Sevan A Aydin
(74) *Attorney, Agent, or Firm* — Oliff PLC

(57) ABSTRACT

Provided is an image forming apparatus including an image holder that is mounted at a predetermined mount position, a charging member that charges the image holder, a cleaning member that cleans the charging member, a holding member that holds the charging member and the cleaning member, includes a mount section on which the cleaning member is mounted, is urged toward the image holder side, and recedes when the image holder is mounted at the predetermined mount position, and a drop-out prevention section that is disposed at a position facing the mount section which is included in the holding member at a receding position and that prevents the cleaning member from dropping out from the mount section.

20 Claims, 6 Drawing Sheets

IMAGE FORMING APPARATUS AND IMAGE FORMING UNIT

CROSS-REFERENCE TO RELATED APPLICATIONS

This application is based on and claims priority under 35 USC 119 from Japanese Patent Application No. 2014-147072 filed Jul. 17, 2014.

BACKGROUND

Technical Field

The present invention relates to an image forming apparatus and an image forming unit.

SUMMARY

According to an aspect of the invention, there is provided an image forming apparatus including:

an image holder that is mounted at a predetermined mount position;

a charging member that charges the image holder;

a cleaning member that cleans the charging member;

a holding member that holds the charging member and the cleaning member, includes amount section on which the cleaning member is mounted, is urged toward the image holder side, and recedes when the image holder is mounted at the predetermined mount position; and a drop-out prevention section that is disposed at a position facing the mount section which is included in the holding member at a receding position and that prevents the cleaning member from dropping out from the mount section.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described with reference to the accompanying drawings.

Figure 1:
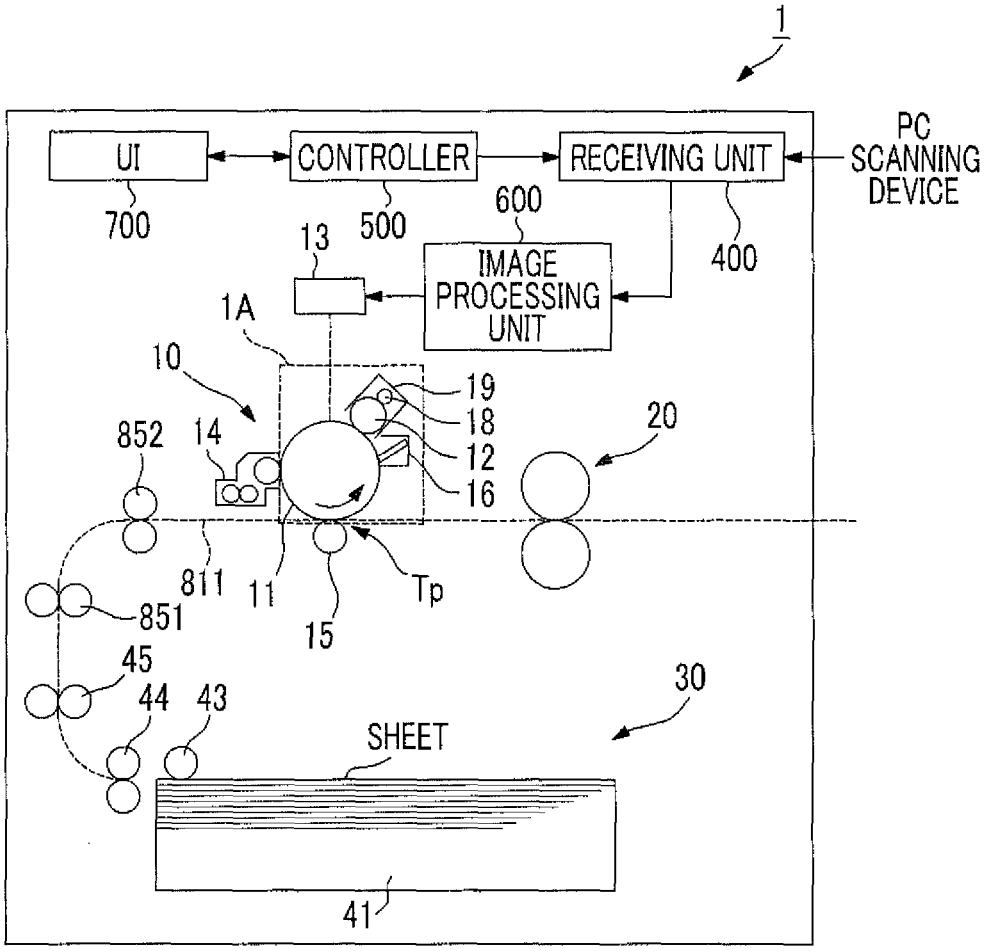
FIG. 1 is a view schematically illustrating a configuration of an image forming apparatus to which an exemplary embodiment is applied.

FIG. 1 is a view schematically illustrating a configuration of an image forming apparatus 1 to which the exemplary embodiment is applied. The image forming apparatus 1 is provided with an image forming unit 10 that forms a toner image on a sheet as an example of a recording material, a fixing unit 20 that heats and presses to fix the toner image formed on the sheet by the image forming unit 10, and a sheet supplying unit 30 that supplies a sheet to the image forming unit 10.

The image forming unit 10 is provided with a photosensitive drum 11 as an example of an image holder. Further, in the image forming unit 10, a charging member 12, an exposure device 13, a developing device 14, a transfer device 15, a cleaning device 16, a cleaning member 18, and a holding member 19 are provided.

The photosensitive drum 11 includes a photosensitive layer on the outer circumferential surface thereof and performs rotational driving in an arrow direction (counterclockwise direction) in FIG. 1.

The charging member 12 is configured of a charging roll that is in contact with the photosensitive drum 11 and charges the rotating photosensitive drum 11 to a predetermined potential. To be more specific, the charging member 12 applies a voltage to the photosensitive drum 11 so as to charge the photosensitive drum 11 to the predetermined potential.

The exposure device 13 selectively exposes portions of the photosensitive drum 11 charged to the predetermined potential by the charging member 12 and forms an electrostatic latent image.

The developing device 14 develops the electrostatic latent image formed on the photosensitive drum 11 by using toner and forms a toner image on the photosensitive drum 11.

The transfer device 15 is formed into a roll-like shape and is disposed along an axial direction of the photosensitive drum 11. The transfer device 15 applies a bias voltage to a transfer unit Tp, thereby transferring the toner image on the photosensitive drum 11 (toner image held by the photosensitive drum 11) to the sheet. In other words, the transfer device 15 forms an electric field between the transfer device 15 and the photosensitive drum 11 and transfers the toner image on the photosensitive drum 11 to the sheet.

The cleaning device 16 includes a cleaning blade disposed to be in contact with the photosensitive drum 11 and removes toner or the like remaining on the photosensitive drum 11.

The cleaning member 18 is configured of a roll-like member that is in contact with the charging member 12 and performs cleaning of the charging member 12.

The holding member 19 holds the charging member 12 and the cleaning member 18. Two holding members 19 are provided so as to correspond to one end and the other end of the charging member 12 and the cleaning member 18 in the axial direction, respectively. In other words, the holding members 19 are provided on the front side of the paper surface in FIG. 1 and on the back side of the paper surface in FIG. 1, respectively.

Further, although not illustrated in FIG. 1, an accommodation member (container) 200 (see FIGS. 3A and 3B) which accommodates the holding member 19 is provided.

A sheet storage section 41, a pull-in roll 43, and a pick-out mechanism 44 are provided in the sheet supplying unit 30. The sheet storage section 41 is a rectangular parallelepiped, of which the topside is opened and sheets are stored inside. The pull-in roll 43 comes into contact with the uppermost sheet from a bundle of sheets stored in the sheet storage section 41 and delivers the uppermost sheet toward the pick-out mechanism 44 side. The pick-out mechanism 44 is configured to include a feed roll that is disposed, for example, to be rotatable, and a retard roll of which rotation is limited. The pick-out mechanism 44 picks out, one by one, the sheets delivered from the pull-in roll 43. Then, the picked sheet is delivered toward a transport roll 45.

The transport rolls 45 are configured to include a pair of roll-like members. After stopping the sheet sent from the pick-out mechanism 44 for a while, the transport roll 45 transports the sheet again at a predetermined timing. A sheet path 811 is provided on the downstream side from the transport roll 45. Pre-registration rolls 851 and registration rolls 852 are attached on the sheet path 811.

The pre-registration rolls 851 transport the sheet transported by the transport rolls 45 toward the downstream side and forma loop in cooperation with the registration rolls 852. In addition, the registration rolls 852 stop for a while and thus the transporting of the sheet is stopped temporarily. Then the registration rolls rotate again in accordance with the timing such that a registration adjustment of the transfer unit Tp is performed and the sheet is supplied.

In addition, a receiving unit 400 that receives image data from a PC or a scanning device (not illustrated) is provided in the image forming apparatus 1. Further, a controller 500 that controls operations of the image forming unit 10, the fixing unit 20, and the sheet supplying unit 30, as a whole, are provided.

In addition, an image processing unit 600 that outputs image data to the exposure device 13 after an image process is performed to the image data received by the receiving unit 400 is provided. Further, a user interface (UI) 700 that receives an instruction from a user and displays a message or the like for the user is provided.

The controller 500 is configured to have a central processing unit (CPU), a read only memory (ROM), a random access memory (RAM), and a hard disk drive (HDD) (none illustrated). A processing program retained in the ROM or HDD is executed in the CPU. The processing programs, various tables, parameters, or the like are stored in the ROM. The RAM is used as a work area or the like during the execution of various programs by the CPU.

Figure 2:
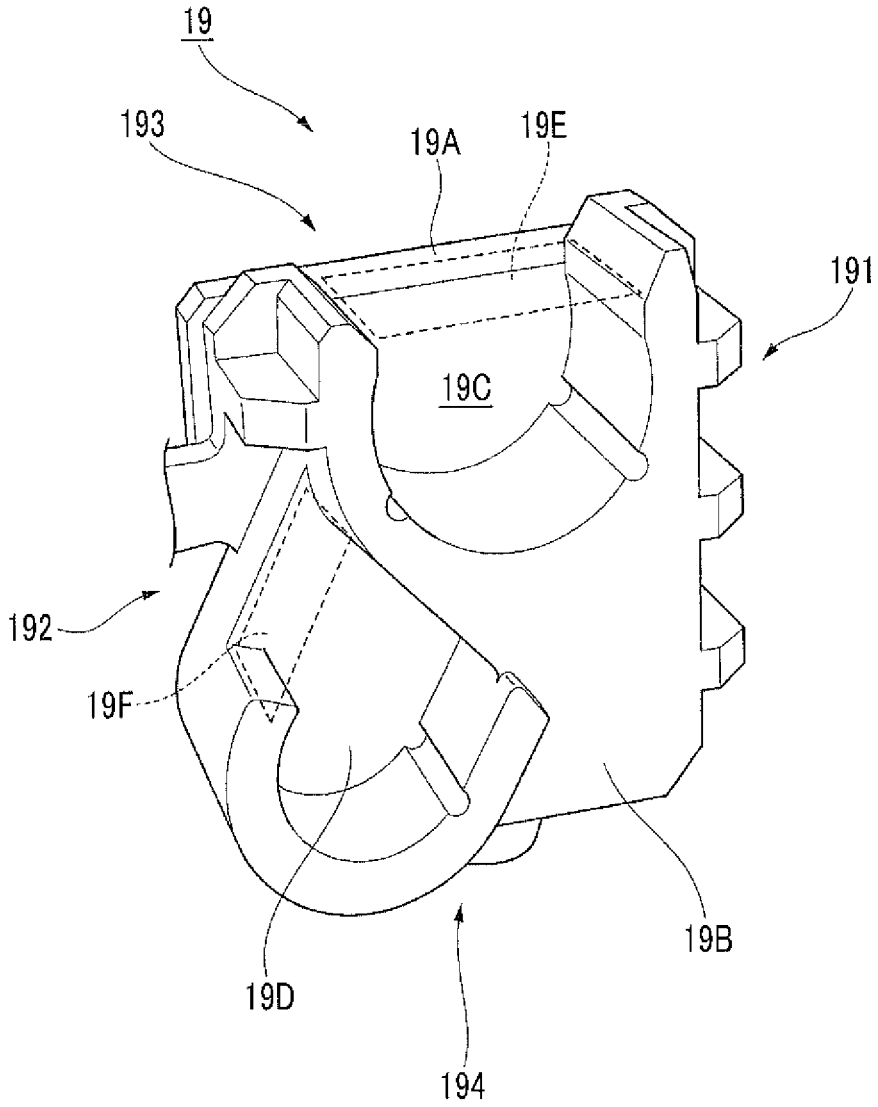
FIG. 2 is a view illustrating a holding member.

FIG. 2 is a view illustrating the holding member 19. In other words, FIG. 2 is a view illustrating the one holding member 19 of the two provided holding members 19. The other holding member 19 is formed to have the same shape as the one holding member 19. To be more exact, according to the exemplary embodiment, the one holding member 19 and the other holding member 19 are formed to have the same shape except that the holding members are formed to be vertically symmetrical to each other. Here, the one holding member 19 is described.

As illustrated in FIG. 2, in the holding member 19, a plate-like base section 19A that is positioned on the back side in FIG. 2, and a protrusion section 19B that protrudes from one side surface (side surface in the front side in FIG. 2) of the base section 19A are provided. The protrusion section 193 includes a right-side surface 191, a left-side surface 192, a top surface 193, and an under surface 194.

In addition, in the holding member 19, a first accommodation groove 19C that is formed from the top surface 193 of the holding member 19 toward the inside of the holding member 19 and a second accommodation groove 19D that is formed from the left-side surface 192 of the holding member 19 toward the inside of the holding member 19 are provided.

In addition, on the top surface 193 of the holding member 19, a first opening 19E that causes the inside and the outside of the first accommodation groove 19C to communicate with each other is formed. The detailed description thereof will be provided later. According to the exemplary embodiment, the charging member 12 is mounted on the inside of the first accommodation groove 19C. During the mounting, the charging member 12 passes through the first opening 19E.

Further, on the left-side surface 192 of the holding member 19, a second opening 19F that causes the inside and the outside of the second accommodation groove 19D to communicate with each other is formed. The cleaning member 18 is mounted on the inside of the second accommodation groove 19D to be described in detail later) and during the mounting, the cleaning member 18 passes through the second opening 19F.

Figure 3B:
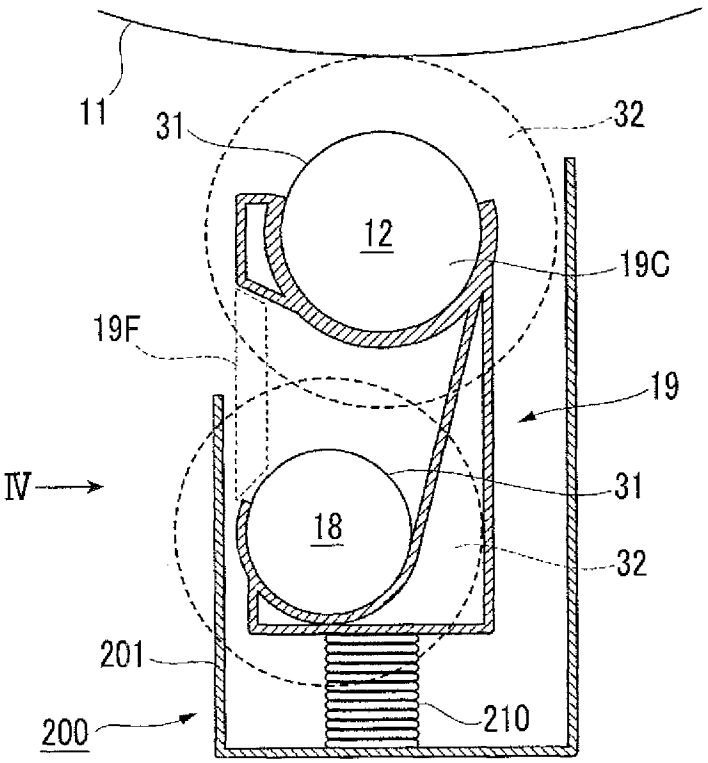
FIGS. 3A and 3B are views illustrating an assembly order of the image forming apparatus and, particularly, an assembly order during mounting a charging member and a cleaning member.
Figure 3A:
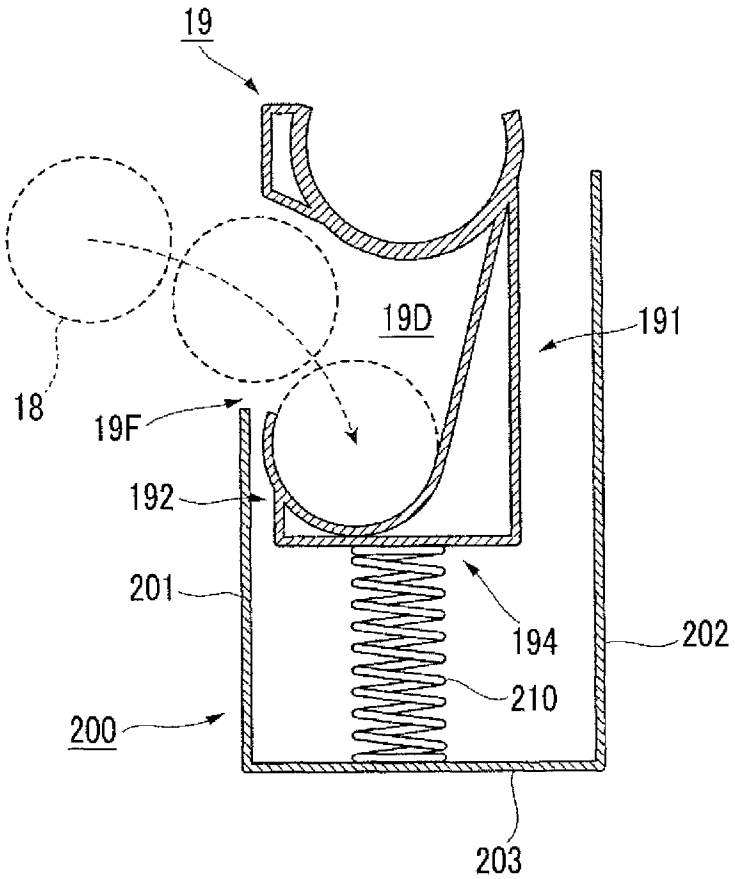

FIGS. 3A and 3B are views illustrating an assembly order of the image forming apparatus 1 and, particularly, an assembly order during mounting the charging member 12 and the cleaning member 18.

During mounting the charging member 12 and the cleaning member 18, as illustrated in FIG. 3A, first, the cleaning member 18 is mounted on the inside of the second accommodation groove 19D provided in the holding member 19.

According to the exemplary embodiment, the inside of the second accommodation groove 19D corresponds to amount section on which the cleaning member 18 is mounted and according to the exemplary embodiment, first, the cleaning member 18 is mounted on the mount section. To be more specific, the cleaning member 18 passes through the second opening 19F (also see FIG. 2) and is mounted on the inside of the second accommodation groove 19D.

Although not described above, according to the exemplary embodiment, as illustrated in FIG. 3A, the accommodation member (container) 200 that accommodates the holding member 19 is provided. Here, on the accommodation member 200, a first side wall 201, a second side wall 202, and a bottom 203 are provided.

The first side wall 201 is disposed such that a part thereof faces the left-side surface 192 of the holding member 19. The second side wall 202 is disposed to face the right-side surface 191 of the holding member 19. The bottom 203 is disposed to face the under surface 194 of the holding member 19. In addition, according to the exemplary embodiment, the height of the first side wall 201 is less than the height of the second side wall 202.

Further, a coil spring 210 that urges the holding member 19 upward in FIGS. 3A and 3B (urges to a side where the photosensitive drum 11 is provided) is provided between the under surface 194 of the holding member 19 and the bottom 203 of the accommodation member 200.

Here, according to the exemplary embodiment, when mounting of the cleaning member 18 on the holding member 19 is performed, the holding member 19 is displaced upward by the coil spring 210. In this way, the second opening 19F of the holding member 19 is exposed. According to the exemplary embodiment, first, the cleaning member 18 is mounted on the inside of the second accommodation groove 19D through the exposed second opening 19F.

Then, according to the exemplary embodiment, as illustrated in FIG. 3B, the charging member 12 is mounted on the first accommodation groove 19C of the holding member 19. In other words, according to the exemplary embodiment, the inside of the first accommodation groove 19C functions as a charging member mount section on which the charging member 12 is mounted and the charging member 12 is mounted on the charging member mount section.

Although not described above, the charging member 12 and the cleaning member 18 are configured to include, for example, a shaft 31 and an elastic member 32 such as a sponge, rubber, or the like as illustrated in FIG. 3B.

Next, as illustrated in FIG. 3B, mounting of the photosensitive drum 11 is performed. To be more specific, according to the exemplary embodiment, the photosensitive drum 11 is mounted at a predetermined mount position on the upper side in FIG. 3B from the charging member 12. When the photosensitive drum 11 is mounted, the charging member 12 is pressed from the upper side in the drawing and, thereby, the holding member 19 moves downward in the drawing. In other words, the holding member 19 recedes in a direction of being separated from the mount position of the photosensitive drum 11.

When the holding member 19 recedes, as illustrated in FIG. 3B, the first side wall 201 of the accommodation member 200 is positioned at the position facing the second opening 19F provided in the holding member 19. In this way, according to the exemplary embodiment, the cleaning member 18 is prevented from dropping out through the second opening 19F. In other words, even when the cleaning member 18 is caused to drop out from the holding member 19 through the second opening 19F, the cleaning member 18 comes into contact with the first side wall 201 that functions as the drop-out prevention section and the movement of the cleaning member 18 is regulated thereto.

According to the exemplary embodiment, when the holding member 19 recedes, the first side wall 201 of the accommodation member 200 is positioned at the position facing the second opening 19F. Before the holding member 19 recedes, as illustrated in FIG. 3A, the second opening 19F is disposed at a position (position on the upper side in the drawing from the first side wall 201) which is different from the position where the second opening 19F faces the first side wall 201. Accordingly, according to the exemplary embodiment, before the holding member 19 recedes, the mounting of the cleaning member 18 on the inside of the second accommodation groove 19D is performed without being interrupted by the first side wall 201.

Figure 4:
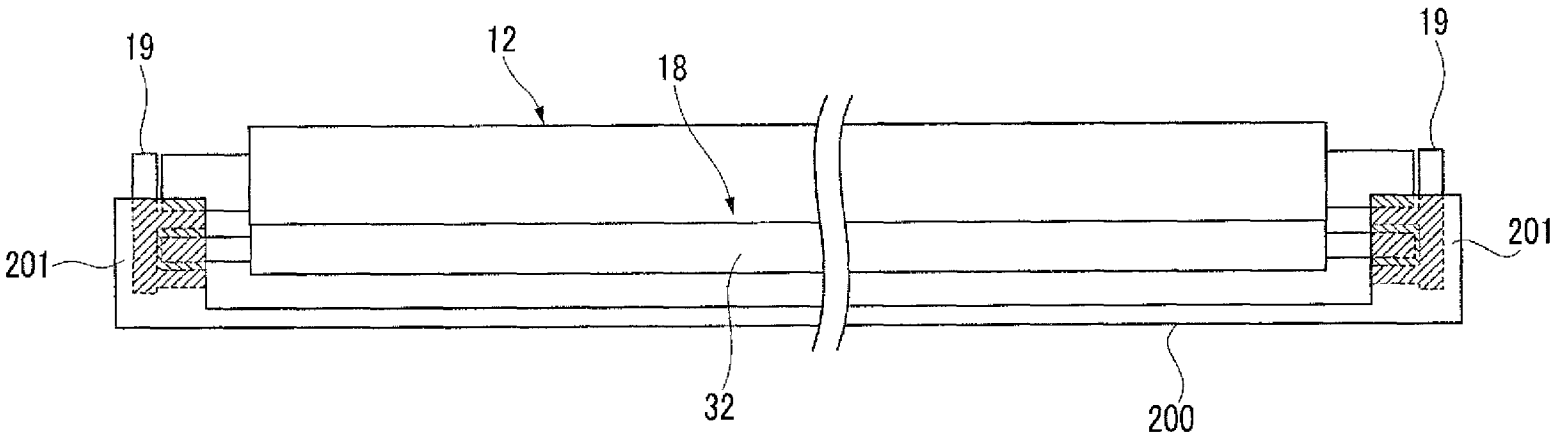
FIG. 4 is a view illustrating the charging member and the cleaning member when viewed from a direction of arrow TV in FIG. 3B.

FIG. 4 is a view illustrating the charging member 12 and the cleaning member 18 when viewed from a direction of arrow IV in FIG. 3B. In FIG. 4, the photosensitive drum 11 is not illustrated.

According to the exemplary embodiment, as described above, dropping out of the cleaning member 18 from the holding member 19 is prevented using the first side wall 201; however, the first side wall 201 may be formed to face the entire region in the longitudinal direction of the cleaning member 18 or may be formed to face a part of the cleaning member 18 (one end or the other end of the cleaning member 18) as illustrated in FIG. 4.

Bearings that support the cleaning member 18 in a state in which the cleaning member 18 is rotatable are provided in the one end and the other end of the cleaning member 18, respectively. According to the exemplary embodiment, the first side wall 201 is provided so as to face each of the two bearings. To be more exact, according to the exemplary embodiment, the first side wall 201 is provided so as to face the second openings 19F described above which are included in the two holding members 19.

In a case where the first side wall 201 is formed to face the one end and the other end of the cleaning member 18 as described above without forming the first side wall 201 to face the entire region in the longitudinal direction of the cleaning member 18, interference between the elastic member 32 and the first side wall 201 is avoided as illustrated in FIG. 4 and flexibility of a layout is increased. In addition, in a case where the first side wall 201 is positioned at a position where the first side wall 201 does not interfere with the elastic member 32 (case where the first side wall 201 is not provided at a position facing the elastic member 32), the elastic member 32 may have a larger diameter and it is expected that performance of cleaning is improved compared to a case where the elastic member 32 has a small diameter.

A functional section such as the first side wall 201 which prevents the cleaning member 18 from dropping out may be configured of a separate member from the accommodation member 200. In addition, the functional section that prevents the dropping out may be formed to be integral to the accommodation member 200. In other words, the functional section may be formed of a part of the accommodation member 200. In a case where the functional section and the accommodation member 200 are formed to be integral to each other (case where the functional section is formed of a part of the accommodation member 200), the number of components is decreased and a manufacturing cost is decreased compared to a case where the functional section is formed of a separate member.

Figure 5:
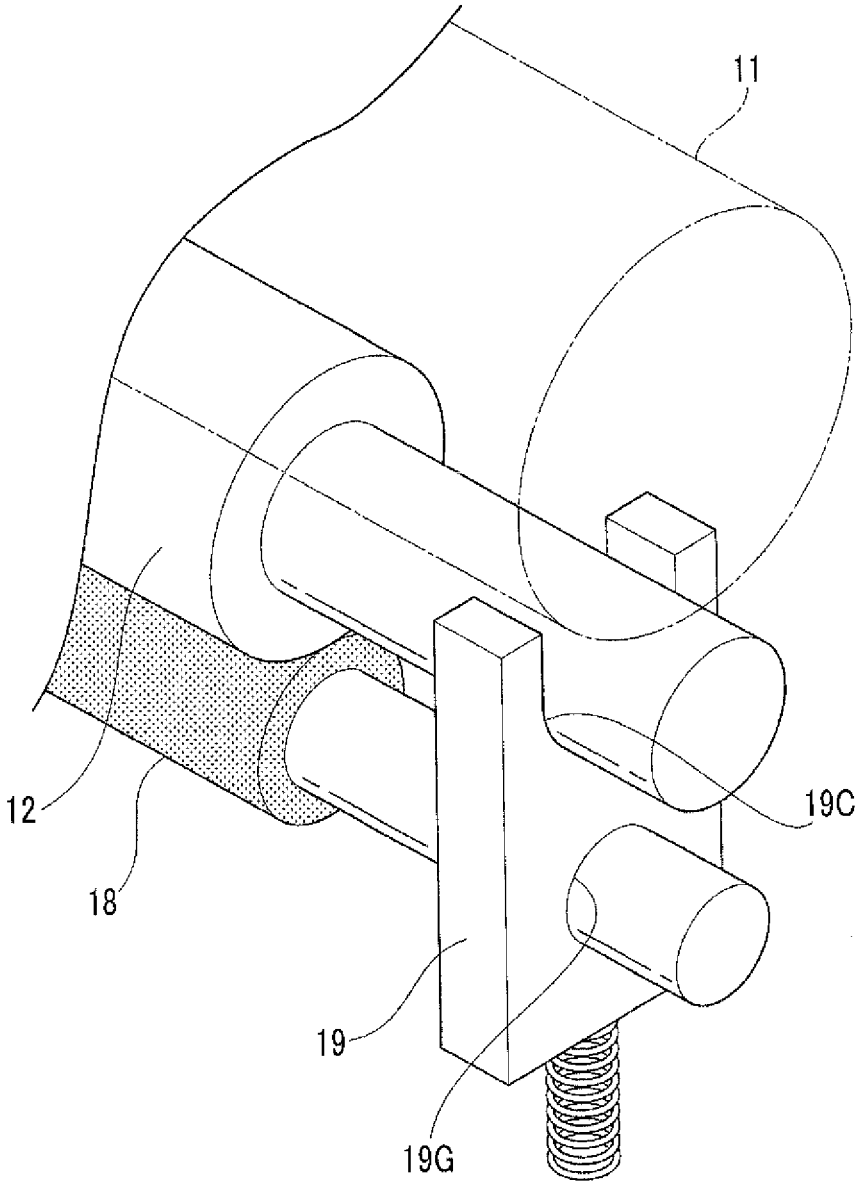
FIG. 5 is a view illustrating a comparative example of a holding member.
Figure 6:
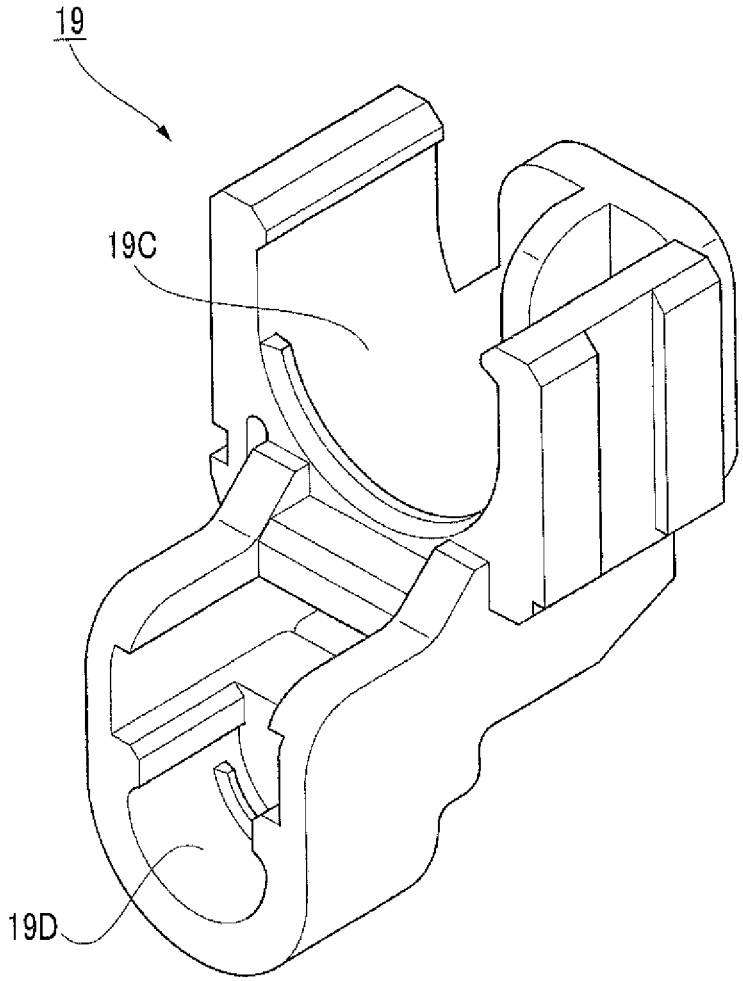
FIG. 6 is a view illustrating another comparative example of a holding member.

FIGS. 5 and 6 are views illustrating a comparative example of the holding member 19.

According to the comparative example illustrated in FIG. 5, in the holding member 19, the first accommodation groove 19C that accommodates the charging member 12 and a through-hole 19G into which the cleaning member 18 is inserted are provided.

According to the comparative example, during the assembly, a process is needed, in which the cleaning member 18 penetrates through the through-hole 19G and, thus time and effort are required for assembly compared to the configuration according to the exemplary embodiment.

In other words, according to the comparative example, during the assembly, movement of the cleaning member 18 and movement of the holding member 19 along the axial direction of the cleaning member 18 are needed and, thus time and effort are required. To be more exact, according to the comparative example, a process of moving the charging member 12 in a radial direction (process of moving the charging member 12 downward from the upper side in the drawing) and a process of moving the cleaning member 18 or the like along the axial direction of the cleaning member 18 are mixed and, thus time and effort are needed.

Meanwhile, in the configuration according to the exemplary embodiment, since both the charging member 12 and the cleaning member 18 are caused to move in the radial direction such that the assembly is performed, the assembly is easy compared to the comparative example illustrated in FIG. 5.

Next, the comparative example illustrated in FIG. 6 will be described.

According to the comparative example illustrated in FIG. 6, similar to the exemplary embodiment, two accommodation grooves of the first accommodation groove 19C that accommodates the charging member 12 and the second accommodation groove 19D that accommodates the cleaning member 18 are formed. Further, according to the comparative example, a mount position of the first accommodation groove 19C and a mount position of the second accommodation groove 19D are displaced from each other in the axial direction of the charging member 12 and the cleaning member 18; that is, the first accommodation groove 19C is positioned on the outer side (in a case where the center of the charging member 12 in the axial direction is a reference point, a side separated from the reference point) from the second accommodation groove 19D.

When an assembly order in the comparative example illustrated in FIG. 6 is described, first, the cleaning member 18 is mounted to the second accommodation groove 19D from the upper side in FIG. 6. Next, the charging member 12 is mounted to the first accommodation groove 19C in the same way as from the upper side in FIG. 6. Then, the photosensitive drum 11 is mounted on the upper side of the charging member 12 in FIG. 6.

According to the comparative example, since the charging member 12 and also the cleaning member 18 are mounted on the holding member 19 from the upper side in FIG. 6, movement of the cleaning member 18 or the like in the axial direction as illustrated in FIG. 5 is not needed and the assembly is simpler compared to the configuration illustrated in FIG. 5. In addition, according to the comparative example, since the charging member 12 is positioned on the upper side of the cleaning member 18 in the drawing and the photosensitive drum 11 is positioned on the upper side of the charging member 12 in the drawing, only the simple set of the cleaning member 18 and the charging member 12 on the holding member 19 prevents these members from dropping out.

Meanwhile, according to the comparative example illustrated in FIG. 6, the first accommodation groove 19C positioned on the upper side is needed to be provided on the outer side from the second accommodation groove 19D positioned on the lower side in the configuration. In this case, the holding member 19 is increased in size and, thereby, the overall apparatus is increased in size.

To be more exact, in recent years, the entire length of the charging member 12 is shortened and there is no difference between the length of the charging member 12 and that of the cleaning member 18 in accordance with weight lightening and miniaturization. Regardless of such a situation, according to the comparative example illustrated in FIG. 6, the charging member 12 has to be longer than the cleaning member 18 and, thus it is unlikely to achieve the weight lightening and miniaturization.

Next, when the configuration according to the exemplary embodiment is described, each of the charging member 12 and the cleaning member 18 is caused to move in the radial direction and is mounted on the holding member 19. Therefore, the assembly may be performed without the movement in the axial direction unlike the comparative example illustrated in FIG. 5 and, thus the process of the assembly is simplified compared to the comparative example illustrated in FIG. 5.

Further, in the configuration according to the exemplary embodiment, the openings (first opening 19E and second opening 19F) are separately provided such that the charging member 12 and the cleaning member 18 are accommodated in the accommodation grooves (first accommodation groove 19C and second accommodation groove 19D) by using the openings, respectively. In this way, unlike in FIG. 6, an increase of the holding member 19 in size is suppressed.

In other words, according to the exemplary embodiment, the passage (cleaning member passage) through which the cleaning member 18 passes when the cleaning member 18 is mounted on the holding member 19 and the passage (charging member passage) through which the charging member 12 passes when the charging member 12 is mounted on the holding member 19 are formed separately from each other. Therefore, there is no need for the charging member 12 to be longer than the cleaning member 18 and, thereby, instead of the holding member 19 illustrated in FIG. 6, the holding member 19 illustrated in FIG. 2 which is smaller is employed. Accordingly, in the configuration according to the exemplary embodiment, the miniaturization of the entire apparatus is achieved compared to the comparative example illustrated in FIG. 6.

Meanwhile, as in the exemplary embodiment, when the passages for mounting the charging member 12 and the cleaning member 18 are separately provided and the openings for mounting the charging member 12 and the cleaning member 18 are separately provided, the movement of the cleaning member 18 is not likely to be regulated in a type as illustrated in FIG. 6. Specifically, the movement of the cleaning member 18 is unlikely to be regulated by the charging member 12. As a result, in the configuration according to the exemplary embodiment, only the simple mounting of the cleaning member 18 on the holding member 19 may cause the cleaning member 18 to drop out from the holding member 19.

According to the exemplary embodiment, as described above, when the charging member 12 is pressed by the photosensitive drum 11 and the holding member 19 recedes, the second opening 19F is positioned at a position facing the first side wall 201 of the accommodation member 200. Accordingly, the second opening 19F is blocked and the cleaning member 18 is prevented from dropping out from the second opening 19F.

Here, in the configuration according to the exemplary embodiment, the cleaning member 18 is prevented from dropping out without a user's special operation for preventing the cleaning member 18 from dropping out. In other words, according to the exemplary embodiment, only the mounting itself of the cleaning member 18, the charging member 12, and the photosensitive drum 11 prevents the cleaning member 18 from dropping out.

To be more exact, according to the exemplary embodiment, the cleaning member 18 is prevented from dropping out without any special assembly processes. In other words, according to the comparative example illustrated in FIG. 6, although the cleaning member 18 is prevented from dropping out without any special assembly processes, the apparatus becomes increased in size according to the comparative example. According to the exemplary embodiment, the cleaning member 18 is prevented from dropping out without any special assembly processes and, further, the increase of the apparatus in size is suppressed.

Other Configurations

According to a configuration of the image forming apparatus 1, the photosensitive drum 11 and members positioned around the photosensitive drum 11 are all unitized and form an image forming unit; however, the charging member 12, the cleaning member 18, the holding member 19, and the accommodation member 200 may be included in the image forming unit.

To be more specific, according to the apparatus configuration, there may be an embodiment in which a surrounding portion represented by reference sign 1A in FIG. 1 is unitized as the image forming unit and the image forming unit is attachable to and detachable from the main body side of the image forming apparatus 1.

In such an embodiment, the image forming unit may include the charging member 12, the cleaning member 18, the holding member 19, and the accommodation member 200 which are described above. Here, although there is a case where a replacement with a new image forming unit is performed due to the abrasion of the photosensitive drum 11, the charging member 12, the cleaning member 18, the holding member 19, and the accommodation member 200 are also replaced during the replacement.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holder that is mounted at a predetermined mount position;

a charging member that charges the image holder;

a cleaning member that cleans the charging member;

a holding member that holds the charging member and the cleaning member, includes a mount section on which the cleaning member is mounted, is urged toward the image holder side, and recedes by being pressed by the image holder which is mounted at the predetermined mount position; and a drop-out prevention section comprising a wall that is disposed (1) at a position facing an opening of the mount section when the holding member is at a receding position where the holding member is pressed by the image holder thereby preventing the cleaning member from dropping out from the mount section, and (2) at a position so that the cleaning member can move radially through the opening of the mount section when the holding member is not pressed by the image holder.

2. The image forming apparatus according to claim 1, wherein an opening is formed in the mount section provided in the holding member and causes an inside and an outside of the mount section to communicate with each other such that the cleaning member passes the opening when the cleaning member is mounted on the mount section, and wherein the drop-out prevention section is positioned to face the opening when the holding member recedes, and prevents the cleaning member from dropping out through the opening.

3. The image forming apparatus according to claim 1, wherein, before the image holder is mounted on the predetermined mount position, the mount section provided in the holding member is disposed at a position different from the position facing the drop-out prevention section.

4. The image forming apparatus according to claim 2, wherein, before the image holder is mounted on the predetermined mount position, the mount section provided in the holding member is disposed at a position different from the position facing the drop-out prevention section.

5. The image forming apparatus according to claim 1, further comprising:

an accommodation member that accommodates the holding member, wherein the drop-out prevention section is configured of a part of the accommodation member.

6. The image forming apparatus according to claim 2, further comprising:

an accommodation member that accommodates the holding member, wherein the drop-out prevention section is configured of a part of the accommodation member.

7. The image forming apparatus according to claim 3, further comprising:

an accommodation member that accommodates the holding member, wherein the drop-out prevention section is configured of a part of the accommodation member.

8. The image forming apparatus according to claim 4, further comprising:

an accommodation member that accommodates the holding member, wherein the drop-out prevention section is configured of a part of the accommodation member.

9. The image forming apparatus according to claim 1, wherein the cleaning member is provided to be rotatable, and opposite ends in an axial direction are one end and the other end, and wherein, when the holding member recedes, the drop-out prevention section is positioned at a position facing the one end and the other end of the cleaning member, regulates movement of the one end and the other end, and prevents the cleaning member from dropping out.

10. The image forming apparatus according to claim 2, wherein the cleaning member is provided to be rotatable, and opposite ends in an axial direction are one end and the other end, and wherein, when the holding member recedes, the drop-out prevention section is positioned at a position facing the one end and the other end of the cleaning member, regulates movement of the one end and the other end, and prevents the cleaning member from dropping out.

11. The image forming apparatus according to claim 3, wherein the cleaning member is provided to be rotatable, and opposite ends in an axial direction are one end and the other end, and wherein, when the holding member recedes, the drop-out prevention section is positioned at a position facing the one end and the other end of the cleaning member, regulates movement of the one end and the other end, and prevents the cleaning member from dropping out.

12. The image forming apparatus according to claim 4, wherein the cleaning member is provided to be rotatable, and opposite ends in an axial direction are one end and the other end, and wherein, when the holding member recedes, the drop-out prevention section is positioned at a position facing the one end and the other end of the cleaning member, regulates movement of the one end and the other end, and prevents the cleaning member from dropping out.

13. The image forming apparatus according to claim 5, wherein the cleaning member is provided to be rotatable, and opposite ends in an axial direction are one end and the other end, and wherein, when the holding member recedes, the drop-out prevention section is positioned at a position facing the one end and the other end of the cleaning member, regulates movement of the one end and the other end, and prevents the cleaning member from dropping out.

14. The image forming apparatus according to claim 6, wherein the cleaning member is provided to be rotatable, and opposite ends in an axial direction are one end and the other end, and wherein, when the holding member recedes, the drop-out prevention section is positioned at a position facing the one end and the other end of the cleaning member, regulates movement of the one end and the other end, and prevents the cleaning member from dropping out.

15. The image forming apparatus according to claim 7, wherein the cleaning member is provided to be rotatable, and opposite ends in an axial direction are one end and the other end, and wherein, when the holding member recedes, the drop-out prevention section is positioned at a position facing the one end and the other end of the cleaning member, regulates movement of the one end and the other end, and prevents the cleaning member from dropping out.

16. The image forming apparatus according to claim 8, wherein the cleaning member is provided to be rotatable, and opposite ends in an axial direction are one end and the other end, and wherein, when the holding member recedes, the drop-out prevention section is positioned at a position facing the one end and the other end of the cleaning member, regulates movement of the one end and the other end, and prevents the cleaning member from dropping out.

17. The image forming apparatus according to claim 1, wherein the holding member further includes a charging member mount section on which the charging member is mounted, wherein a charging member passage through which the charging member passes when the charging member is mounted on the charging member mount section is formed in the holding member, and wherein a cleaning member passage which is a separate passage from the charging member passage and through which the cleaning member passes when the cleaning member is mounted on the mount section is formed in the holding member.

18. The image forming apparatus according to claim 2, wherein the holding member further includes a charging member mount section on which the charging member is mounted, wherein a charging member passage through which the charging member passes when the charging member is mounted on the charging member mount section is formed in the holding member, and wherein a cleaning member passage which is a separate passage from the charging member passage and through which the cleaning member passes when the cleaning member is mounted on the mount section is formed in the holding member.

19. The image forming apparatus according to claim 3, wherein the holding member further includes a charging member mount section on which the charging member is mounted, wherein a charging member passage through which the charging member passes when the charging member is mounted on the charging member mount section is formed in the holding member, and wherein a cleaning member passage which is a separate passage from the charging member passage and through which the cleaning member passes when the cleaning member is mounted on the mount section is formed in the holding member.

20. An image forming unit comprising:

an image holder that is mounted at a predetermined mount position;

a charging member that charges the image holder;

a cleaning member that cleans the charging member;

a holding member that holds the charging member and the cleaning member, includes a mount section on which the cleaning member is mounted, is urged toward the image holder side, and recedes by being pressed by the image holder which is mounted at the predetermined mount position; and a drop-out prevention section comprising a wall that is disposed (1) at a position facing an opening of the mount section when the holding member is at a receding position where the holding member is pressed by the image holder thereby preventing the cleaning member from dropping out from the mount section, and (2) at a position so that the cleaning member can move radially through the opening of the mount section when the holding member is not pressed by the image holder, wherein the image forming unit is attachable to and detachable from a main body side of an image forming apparatus.

* * * * *